US006896056B2

(12) United States Patent
Mendez et al.

(10) Patent No.: US 6,896,056 B2
(45) Date of Patent: May 24, 2005

(54) SYSTEM AND METHODS FOR DETECTING CASING COLLARS

(75) Inventors: Luis Mendez, Houston, TX (US); Darrin Willauer, Austin, TX (US); James R. Bridges, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 4 days.

(21) Appl. No.: 10/156,399

(22) Filed: May 28, 2002

(65) Prior Publication Data

US 2003/0010495 A1 Jan. 16, 2003

Related U.S. Application Data

(60) Provisional application No. 60/295,436, filed on Jun. 1, 2001, and provisional application No. 60/343,039, filed on Dec. 20, 2001.

(51) Int. Cl.[7] ..... E21B 47/00

(52) U.S. Cl. ..... 166/254.2; 166/66; 73/152.54

(58) Field of Search ..... 166/250.01, 254.1, 166/254.2, 255.1, 60; 73/132.54, 152.57

(56) References Cited

U.S. PATENT DOCUMENTS

| | | | | |
|---|---|---|---|---|
| 2,547,875 A | | 4/1951 | Krasnow | 73/359 |
| 2,888,309 A | | 5/1959 | Tanguy | 346/33 |
| 2,897,440 A | | 7/1959 | Hawthorne | 324/37 |
| 3,381,750 A | | 5/1968 | Brown | 166/64 |
| 3,750,098 A | * | 7/1973 | Zill | 340/855.3 |
| 3,821,696 A | | 6/1974 | Harrell et al. | 340/18 |
| 4,216,536 A | | 8/1980 | More | 367/83 |
| 4,314,365 A | | 2/1982 | Petersen et al. | 367/82 |
| 4,852,070 A | | 7/1989 | Stuart-Bruges | 367/81 |
| 4,992,997 A | | 2/1991 | Bseisu | 367/82 |
| 5,279,366 A | * | 1/1994 | Scholes | 166/254.2 |
| 5,413,174 A | * | 5/1995 | Schmidt | 166/250.01 |
| 5,429,190 A | | 7/1995 | Kilgore et al. | 166/255 |
| 5,494,105 A | | 2/1996 | Morris | 166/255.1 |
| 5,626,192 A | | 5/1997 | Connell et al. | 166/255.1 |
| 5,774,420 A | | 6/1998 | Heysse et al. | 367/83 |
| 5,947,213 A | | 9/1999 | Angle et al. | 175/24 |
| 6,041,860 A | | 3/2000 | Nazzal et al. | 166/250.01 |
| 6,237,410 B1 | * | 5/2001 | Dyck et al. | 73/290 V |

FOREIGN PATENT DOCUMENTS

EP 0697497 2/1996

OTHER PUBLICATIONS

"A New Method for Communicating Downhole Sensor Data Within the Annulus of a Production Well"; Authors: J. V. Leggett III & B. R. Green, Society of Petroleum Engineers 28522; SPE 69$^{th}$ Annual Technical Conference & Exhibition, New Orleans, LA, Sept. 25–28, 1994; pp. 33–42.

"Method and Apparatus for Improved Acoustic Coupling for Acoustic Signal Communication in a Wellbore", Research Disclosure, May 1999, 622–625.

* cited by examiner

*Primary Examiner*—David Bagnell
*Assistant Examiner*—Jennifer R. Dougherty
(74) *Attorney, Agent, or Firm*—Maden, Mossman & Sriram, P.C.

(57) ABSTRACT

A tubing conveyed casing collar locator system that detects the casing collars in a wellbore and acoustically transmits the information through the tubing to the surface where it is detected and processed in a surface processor. The system comprises a downhole tool which comprises downhole sensors, a signal processor with memory, a drive circuit, a battery pack, and a signal generator. The surface system comprises a surface processor, depth system, and acoustic signal transmitter/receiver. The downhole tool detects casing collars as the tool is moved through the collar and acoustically transmits the data or stores the data in downhole memory according to programmed instructions. In one embodiment, the tool compares sensor signals from production elements, such as valves, to stored sensor signatures to uniquely identify the downhole element. In one embodiment, the downhole tool changes operating modes in response to surface command.

30 Claims, 6 Drawing Sheets

SYSTEM AND METHODS FOR DETECTING CASING COLLARS

This application claims the benefit of U.S. Provisional Application No. 60/295,436 filed on Jun. 1, 2001 and No. 60/343,039 filed on Dec. 20, 2001

BACKGROUND OF THE INVENTION

1. Field of the Invention

The present invention relates generally to oilwell casing string joint locators, and more particularly, to a joint locator and methods for positioning a well tool connected to a length of coiled or jointed tubing in a well.

2. Description of the Related Art

In the drilling and completion of oil and gas wells, a wellbore is drilled into a subsurface producing formation. Typically, a string of casing pipe is then cemented into the wellbore. An additional string of pipe, commonly known as production tubing, may be disposed within the casing string and is used to conduct production fluids out of the wellbore. The downhole string of casing pipe is comprised of a plurality of pipe sections which are threadedly joined together. The pipe joints, also referred to as collars, have increased mass as compared to the pipe sections. After the strings of pipe have been cemented into the well, logging tools are run to determine the location of the casing collars. The logging tools used include a pipe joint locator whereby the depths of each of the pipe joints through which the logging tools are passed is recorded. The logging tools generally also include a gamma ray logging device which records the depths and the levels of naturally occurring gamma rays that are emitted from various well formations. The casing collar and gamma ray logs are correlated with previous open hole logs which results in a very accurate record of the depths of the pipe joints across the subterranean zones of interest and is typically referred to as the joint and tally log.

It is often necessary to precisely locate one or more of the casing pipe joints in a well. This need arises, for example, when it is necessary to precisely locate a well tool such as a packer or a perforating gun within the wellbore. The well tool is lowered into the casing on a length of tubing. The term tubing refers to either coiled or jointed tubing. The depth of a particular casing pipe joint adjacent or near the desired location at which the tool is to be positioned can readily be found on the previously recorded joint and tally log for the well. Given this readily available pipe joint depth information, it would seem to be a straightforward task to simply lower the well tool connected to a length of tubing into the casing while measuring the length of tubing inserted in the casing. Measuring could be performed by means of a conventional surface tubing measuring device. The tool is lowered until the measuring device reading equals the depth of the desired well tool location as indicated on the joint and tally log. However, no matter how accurate the tubing surface measuring device is, the true depth measurement is flawed due to effects such as tubing stretch, elongation due to thermal expansion, sinusoidal and helical buckling of the tubing, and a variety of other unpredictable deformations in the length of the tubing from which the tool is suspended in the wellbore. In addition, coiled tubing tends to spiral when forced down a well or through a horizontal section of a well.

A variety of pipe string joint indicators have been developed including slick line indicators that can produce drag inside the pipe string and wire line indicators that send an electronic signal to the surface by way of electric cable and others. These devices, however, either cannot be utilized as a component in a coiled tubing system or have disadvantages when so used. Wireline indicators do not work well in highly deviated holes because they depend on the force of gravity to position the tool. In addition, the wire line and slick line indicators take up additional rig time when used with jointed tubing.

Thus, there is a need for an improved joint locator system and method of using the tool whereby the locations of casing joints can be accurately determined, and the information transmitted to the surface, as the coiled or jointed tubing is lowered into a well.

SUMMARY OF THE INVENTION

The present invention provides a casing collar locator system and methods of using the casing collar locator system which overcomes the other shortcomings of the prior art.

The casing collar locator system of the present invention comprises a casing collar locator tool adapted to be attached to the end of a length of coiled or jointed tubing and moved within a pipe string as the tubing is lowered or raised therein. The casing collar locator tool is adapted to connect to other downhole tools which may include packers and perforating guns. A sensing system is disposed in the casing collar locator tool for detecting the increased mass of a pipe casing collar as the locator is moved through the pipe casing collar and for generating an electric output signal in response thereto. An electronic system detects the sensor electric signal and activates an acoustic signal generator to create a surface detectable acoustic signal transmitted through the coiled or jointed tubing related to the location of the pipe casing collar. A surface receiver detects the acoustic signal and transmits the signal to a surface processor. A surface processor receives a continuous signal from a surface tubing depth measuring system and correlates the depth measurement with the received acoustic signals and stores this information to provide graphical and tabular outputs representative of the casing collar locations.

In an alternate mode, the casing collar locator tool is programmed at the surface, before insertion into the wellbore, to store the casing collar indication in downhole memory and to transmit the information to the surface after a programmed time delay has expired.

In another embodiment, a surface acoustic transducer system is adapted to send acoustic command signals to and receive acoustic signals from an acoustic casing collar tool. The casing collar tool is adapted to receive the surface generated command signals and to thereby act according to instructions in the processor of the casing collar tool.

Methods of using the above-described casing collar locator are also provided. The methods basically comprise connecting a casing collar locator tool of this invention to the end of a length of tubing. The casing collar locator automatically generates a surface detectable acoustic signal in the tubing each time the casing collar locator moves through a pipe casing collar. The depth of the casing collar locator and the surface acoustic signal detector are continuously measured, and the measured depths of the casing collar locator corresponding to the detected acoustic signal are recorded to produce an accurate record of the depth of each detected casing collar.

In an alternative method, the casing collar tool is programmed at the surface to store acquired casing collar data in downhole memory and to transmit this data to the surface after a programmed time delay. The casing collar tool is attached to the end of a length of coiled or jointed tubing and the tubing is run into the hole. As the tool is passed through each casing collar, the casing collar sensor generates an electrical signal which is stored in downhole memory as a function of time. Concurrently, a surface depth sensor measures and transmits this depth data to a surface processor. After a surface programmed time delay has expired the data in downhole memory is acoustically transmitted to the surface as a function of time, detected by the surface receiver and sent to the surface processor. The surface processor generates casing collar depth information according to programmed instructions.

In another method, a prior casing collar log is entered into the downhole tool memory along with a desired predetermined location as indicated by the number of collars traversed. The casing collar tool is run into the hole and senses each collar traversed. When the number of collars traversed matches the predetermined location, the tool transmits a signal to the surface, thereby allowing accurate tool placement downhole.

In another embodiment, a method for determining the location of downhole production elements is described. Existing casing collar sensor signatures of various production elements are stored in a memory module of a signal processor in the acoustic casing collar locator tool. The signatures are unique to each kind of element such as packers, valves, gravel pack screens, and other production elements. The casing collar tool is run in the hole on a tubing string moves past a production element, thereby generating an electric signal from the casing collar sensor. The casing collar sensor signal is compared to the stored signature signals using a technique such as cross correlation thereby determining the type of downhole element sensed. The locator tool sends an encoded acoustic signal to the surface indicating the unique element sensed. The surface system correlates the downhole signal and a surface measured depth signal to develop a log of downhole production elements.

In yet another preferred embodiment, a method is described for locating a well tool by using a downhole production element as a locating benchmark. A specific element signature is loaded into the memory of the signal processor of the casing collar locator tool. The locator tool and a well tool are run into the hole. When the casing collar tool senses the preselected element, an acoustic signal is transmitted to the surface. The well tool may then be positioned a predetermined distance from the located production element.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

After a well has been drilled, completed and placed into production, it is often necessary to perform additional work-over operations on the well such as perforating, setting plugs, setting packers and the like. Such work-over operations are often performed utilizing a tubing string. Here the term tubing refers to either a coiled tubing string or a threadedly jointed tubing string. Coiled tubing is a relatively small flexible tubing (commonly 1–3 inches in diameter), which can be stored on a reel. When used for performing well procedures, the tubing is passed through an injector mechanism and a well tool is connected to the end of the tubing. The injector mechanism pulls the tubing from the reel, straightens the tubing and injects it into the well through a seal assembly at the wellhead. Typically, the injector mechanism injects thousands of feet of the coiled tubing into the casing string of the well. A fluid may be circulated through the coiled tubing for operating the well tool or for other purposes. The coiled tubing injector at the surface is used to raise and lower the coiled tubing and the well tool during the downhole operations. The injector also removes the coiled tubing and the well tool as the tubing is rewound on the reel at the end of the downhole operations.

Figure 1:
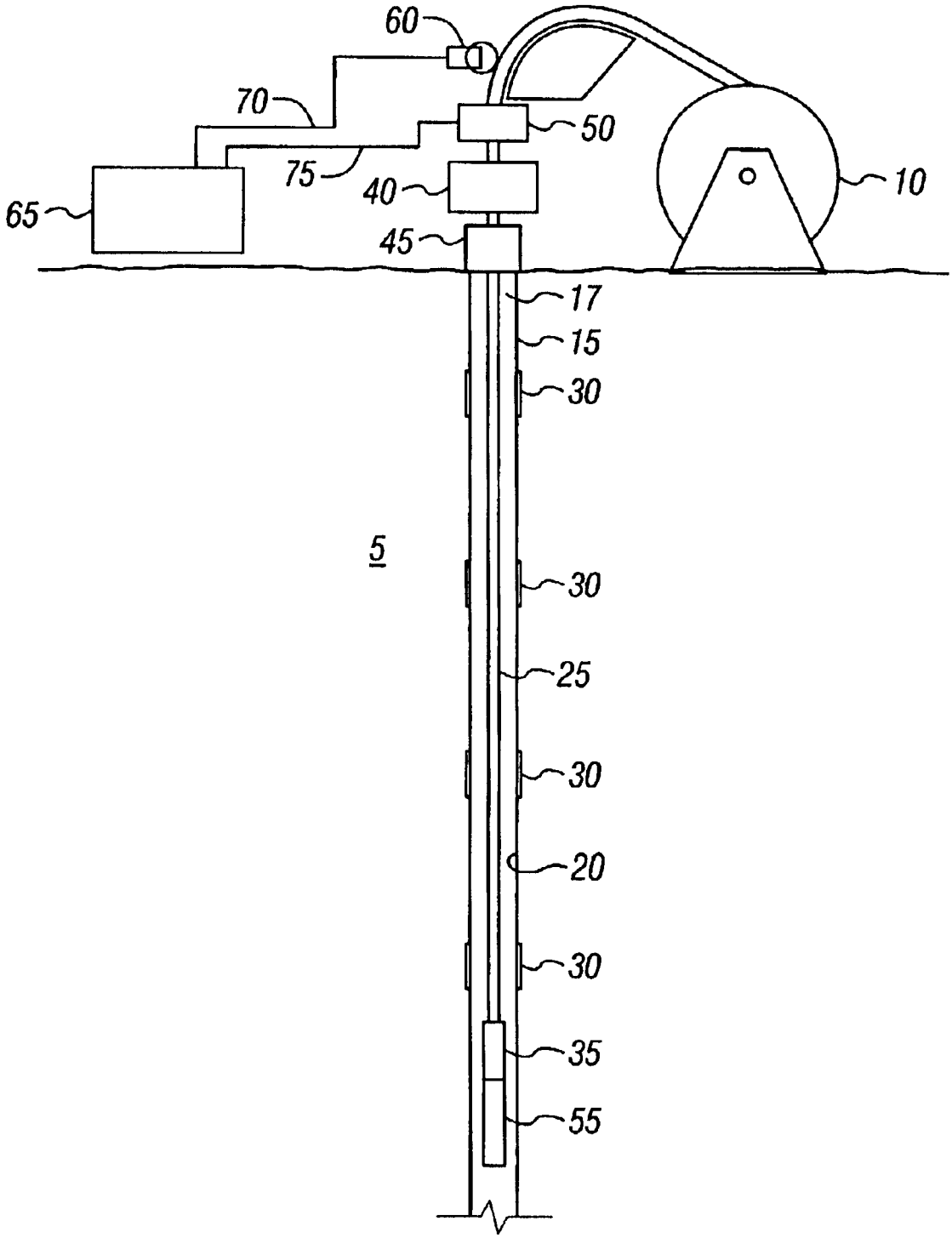
FIG. 1 is a schematic illustration of a system for detecting casing collars in a wellbore and acoustically transmitting this information through a tubing string, according to one embodiment of the present invention.

In FIG. 1, according to one embodiment, well 5 is schematically illustrated along with a coiled tubing injector 40 and a coiled tubing reel assembly 10. The well 5 includes a wellbore 15 having a string of casing 20 cemented therein in the usual manner. The wellbore 15 is typically filled with a completion fluid 17 for maintaining adequate bottom hole pressure on any open hole sections. A length of coiled tubing 25 is inserted into the casing 20. The coiled tubing 25 has an acoustic casing collar locator tool 35 attached to the bottom of the coiled tubing 25. A well tool 55 is attached to the bottom of the acoustic casing collar locator 35. It will be appreciated by those skilled in the art that the positions of the well tool 55 and the locator tool 35 may be interchanged without affecting the system operation. In addition, more than one well tool 55 may be attached to the locator tool 35, either above or below the locator tool 35. Alternatively, a string of jointed production tubing (not shown) may be installed inside the casing 20, and the acoustic casing collar locator 35 run inside the production tubing.

The coiled tubing injector 40 is of a design known to those skilled in the art and functions to straighten the coiled tubing and inject it into the wellbore 15 by way of the wellhead 45. A depth measuring sensor 60, which may be a depth wheel known in the art, functions to continuously measure the length of the coiled tubing within the wellbore 15 and to provide that information to a surface processor 65 by way of depth cable 70. As used here, the term depth refers to the measured depth or length of tubing inserted in the well. Those skilled in the art will realize that the measured depth, and hence the length of tubing, may be different from the vertical depth for wellbores that deviate from the vertical.

Such deviated wellbores are common. The surface processor 65 may be a computer, or microprocessor, with memory capable of running programmed instructions. The processor 65 may also have permanent data storage and hard copy output capabilities. The surface processor 65 functions to continuously record the depth of the coiled tubing 25 and the acoustic casing collar locator 35 attached thereto. This depth information may also be recorded as a function of time and stored in the processor 65. The processor 65 may be a stand alone unit or may be located in an enclosure attached to a coiled tubing skid (not shown) or truck (not shown) or any other suitable enclosure commonly used in the art.

Alternatively, threaded, jointed tubing (not shown) may be used with a conventional derrick system (not shown) to run the casing collar locator tool and a well tool into the hole. The casing collar locator and well tools are attached to the bottom of the jointed tubing and run into the hole. The jointed system may be operated the same as the coiled system with the exception of making up the jointed connections.

Figure 2:
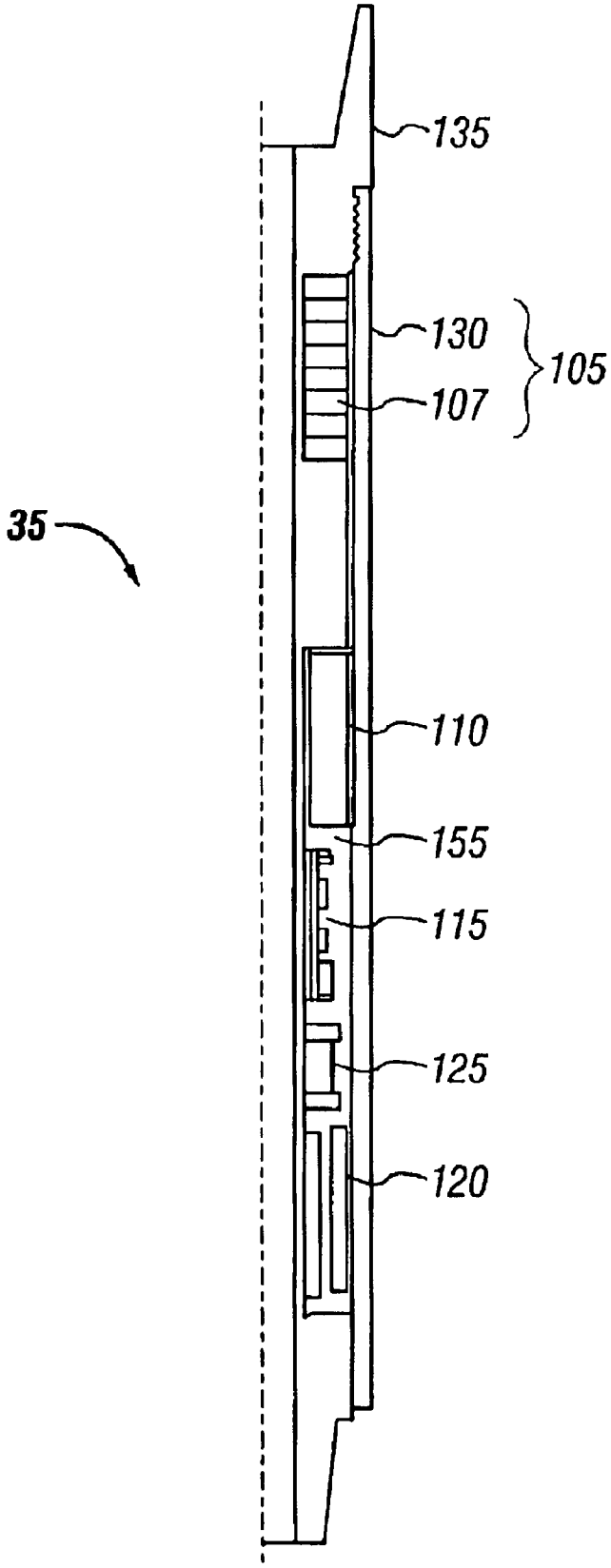
FIG. 2 is a schematic illustration of a downhole tool for detecting casing collars according to one embodiment of the present invention.

Referring to FIG. 2, the acoustic casing collar locator 35 is illustrated schematically. The acoustic casing collar locator 35 comprises a cylindrical mandrel 135 with a through bore to allow undisturbed flow through the coiled tubing 25 to the well tool 55. The upper end of the mandrel 135 is adapted to connect to the lower end of the coiled tubing 25. The ends of the mandrel are adapted to connect to the tubing 25 or the well tools 55 as required for a given operation. As indicated above, the multiple well tools 55 and the collar locator 35 may be attached to the end of the tubing 25 in any order suitable to carry out a particular operation. A housing 130 is adapted to sealably fit over the mandrel 135 and threadably engage a shoulder of the mandrel 135, thereby creating an annular instrument section 155 between the mandrel 135 and the housing 130 which is sealed from fluid intrusion at either end by conventional elastomeric type seals (not shown).

Disposed within the instrument section 155 are a casing collar sensor 125, a battery pack 120, a signal processor 115, a drive circuit 110, and an acoustic signal generator 105. The casing collar sensor 125 is a magnetic device, known to those skilled in the art, for detecting the increased mass of a casing collar 30 as the casing collar sensor 125 is moved through a casing collar 30 joint section. The casing collar sensor 125 generates an electric output signal in response to the increased mass of the casing collar 30. This electrical signal is sensed by suitable circuitry in the signal processor section 115. The signal processor 115 contains analog and digital circuitry (not shown), which may include a microprocessor and memory, adapted to power and sense the output of the casing collar sensor 125 and to store this information in the memory of the signal processor 115. The signal processor 115 is in turn connected by electric wires (not shown), to the drive circuit 110. The drive circuit 110 receives power from the battery pack 120 via electric wires (not shown). The battery pack is comprised of a plurality of batteries (not shown). The drive circuit 110 provides a signal adapted to properly actuate the acoustic signal generator 105 via electric wires, (not shown). The acoustic signal generator 105 consists of a plurality of piezoelectric ceramic elements 107 configured to impart an acoustic impulse to the mandrel 135 when the acoustic signal generator 105 is actuated by the drive circuit 110. Alternatively, magnetostrictive elements (not shown) may be used to impart an acoustic signal into the tubing. The acoustic signal is transmitted through the coiled tubing 25 to the surface where, in one preferred embodiment, it is detected by acoustic signal receiver 50 disposed proximate the injector 40 such that the receiver 50 contacts the coiled tubing 25 as the coiled tubing 25 passes through the injector 40, as described later. The signal processor 115 may be programmed to generate a pulse type signal or a continuous signal of predetermined frequency. The frequency may be selected depending on operational parameters such as depth, tubing size, coiled or jointed tubing or other pertinent parameters.

Figure 3:
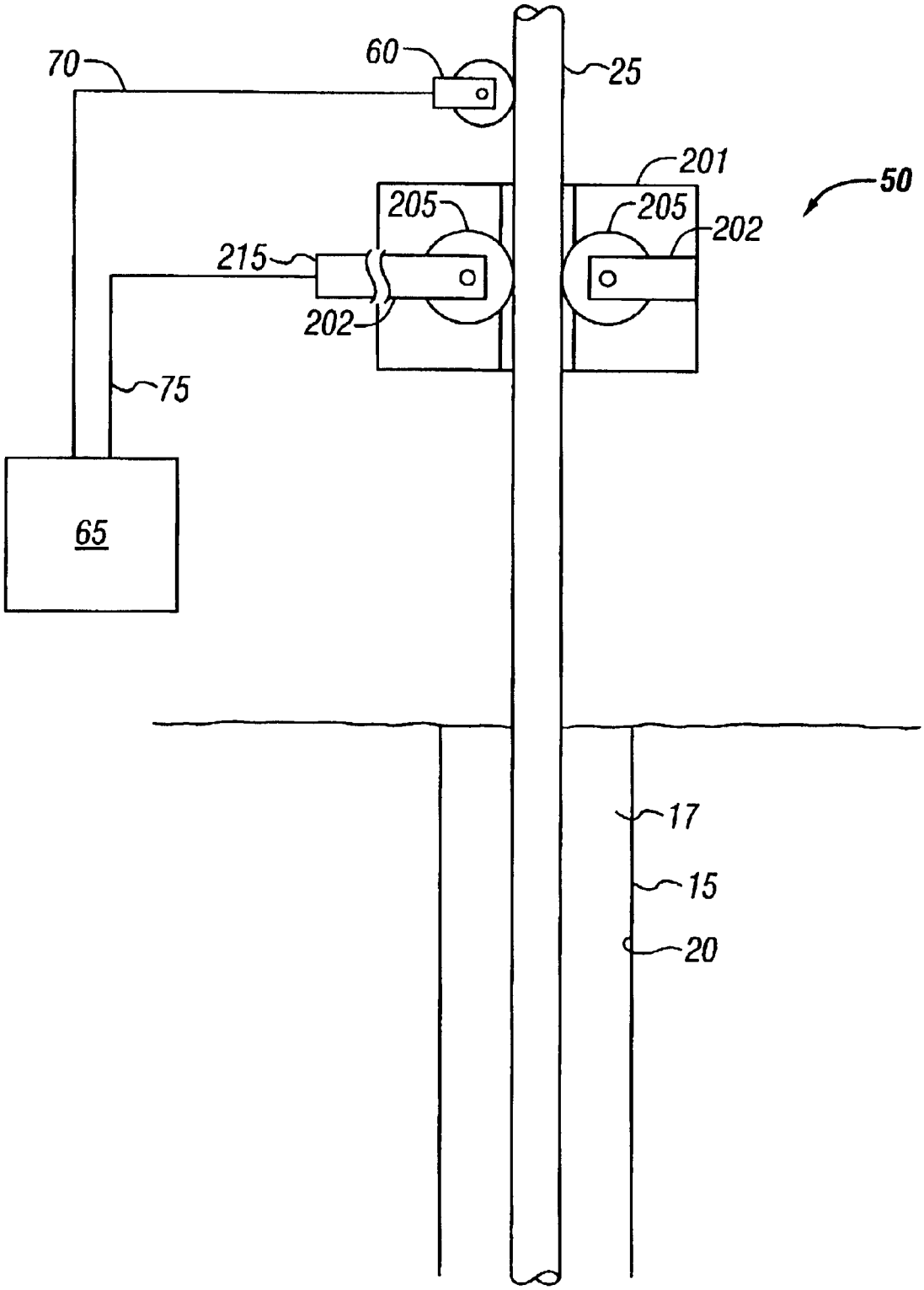
FIG. 3 is a schematic illustration of a surface receiver according to one embodiment of the present invention.

Referring to FIG. 3, in one preferred embodiment, the receiver 50 comprises a housing 201 that contains rolling elements 205 which are forced in contact with the coiled tubing 25 as it is injected in or out of the wellbore 15 lined with casing 20. The rolling elements 205 may be spheres, cylindrical rollers, or wheels coupled to actuators 202 for holding the rolling elements 205 against the coiled tubing 25. The actuators 202 may be mechanically, pneumatically, or hydraulically actuated. Attached to the housing 201 is an accelerometer 215 for sensing vibrations. The acoustic signal, transmitted through the coiled tubing, causes a vibrational response in the rolling elements 205. The vibrational response is transmitted through the housing 201 and is sensed by the accelerometer 215. The accelerometer 215 generates an electrical signal related to the transmitted acoustic signal from downhole. The accelerometer signal is conditioned and transmitted to the surface processor 65.

Figure 4:
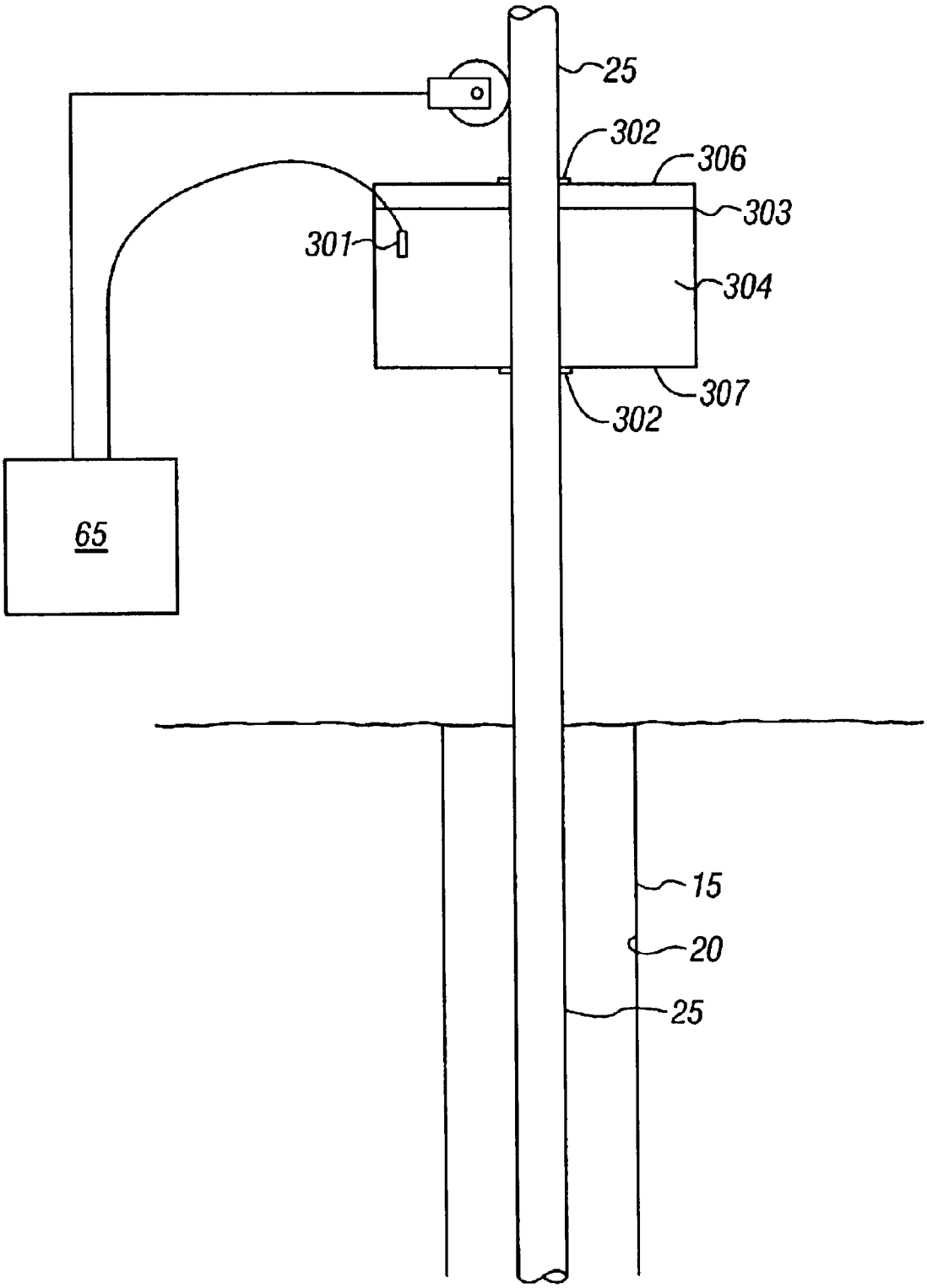
FIG. 4 is a schematic illustration of a surface receiver according to another embodiment of the present invention.

In another preferred embodiment, see FIG. 4, the acoustic signals are detected at the surface by receiver assembly 300 which is acoustically coupled to the coiled tubing 25. The receiver assembly 300 comprises an enclosed fluid-filled reservoir 303 with end caps 306, 307 which are each fitted with seals 302 suitable for moving the coiled tubing 25 through the reservoir 303 with minimal fluid leakage through the seals 302. Any suitable sliding seal, including packing materials, known in the art maybe used. The coiled tubing 25 is in contact with the fluid 304 inside the reservoir 303. The fluid may be water or any other fluid capable of transmitting acoustic energy. As is known in the art, the acoustic signals traveling through the coiled tubing 25 are acoustically coupled to the fluid 304 in the reservoir 303 such that the acoustic signal in the coiled tubing 25 generates a pressure signal in the fluid 304 related to the acoustic signal in the coiled tubing 25. A hydrophone 301 is positioned in the fluid 304 in the reservoir 303 to sense the acoustic related pressure signal in the fluid 304 and transmit an electrical signal to the surface processor 65 related to the pressure signal. The acoustic signal to pressure signal coupling efficiency is relatively low requiring a high sensitivity device such as hydrophone 301 to detect the pressure signal.

Figure 5:
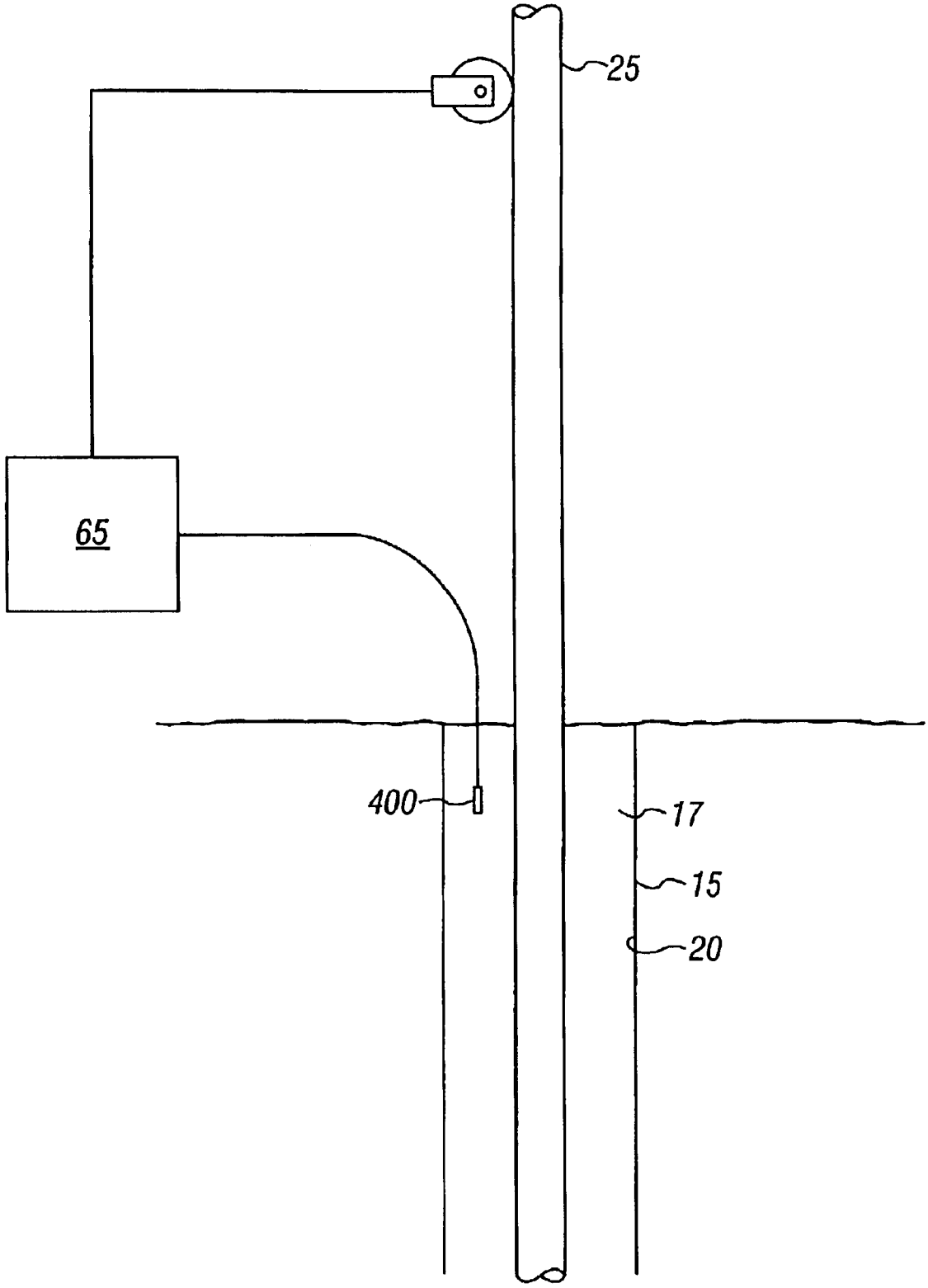
FIG. 5 is a schematic illustration of a surface receiver according to another embodiment of the present invention.

In another preferred embodiment, see FIG. 5, a hydrophone 400 is located in the wellbore fluid 17 in the annular space between the coiled tubing 25 and the casing 20 such that the hydrophone 400 can sense the acoustic related pressure signals coupled to the wellbore fluid 17 from the coiled tubing 25 as the acoustic signal travels in the coiled tubing past the hydrophone 400 location. The hydrophone 400 transmits an electrical signal related to the pressure signal to the surface processor 65.

The acoustic signal sensed by any of the previously described receivers is transmitted to the surface processor 65 via signal cable 75. Signal cables 70 and 75 may be electrical, optical, or pneumatic type cables. Alternatively, wireless transmitters may be employed. Surface processor 65 continuously monitors the depth signal generated and transmitted to the processor 65 by the depth sensor 60. The processor 65 operates according to programmed instructions to correlate the received acoustic signal with the depth of the acoustic casing collar locator 35 as measured by the depth sensor 60. The depth-casing joint information is stored and/or printed out in graphical and tabular format as a log for use in operations. Alternatively, prior depth logs may be stored in the memory of the surface processor 65 and the stored collar locations compared to the detected collar locations for determining an accurate downhole tool placement between collars.

Figure 6:
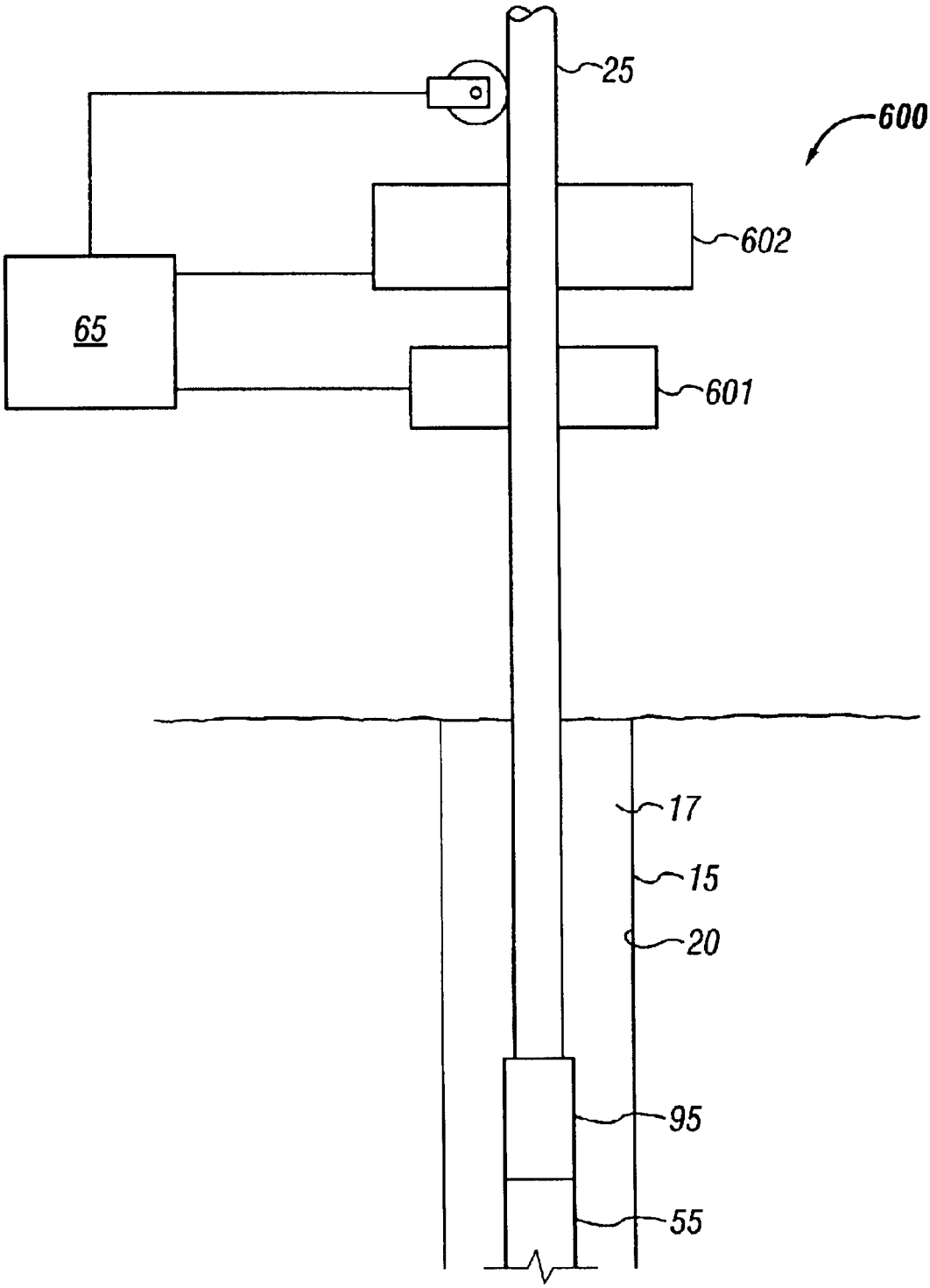
FIG. 6 is a schematic illustration a system for detecting casing collars incorporating two-way communication, according to one embodiment of the present invention.

Referring to FIG. 6, in another preferred embodiment, a two-way surface acoustic transducer system 600 and a downhole acoustic casing collar locator 95 are both adapted to operate as transmitters and receivers to provide two-way communication between the surface and the downhole casing collar locator 95. The two-way surface system 600 comprises a receiver 602, which may be any of the previously described receivers, and an acoustic transmitter 601. The acoustic transmitter may be a clamp on device using piezoelectric elements or alternatively magnetostrictive elements for imparting an acoustic signal into the coiled tubing 25. The rest of the system is as described previously. Here, the surface processor 65 acts according to programmed instructions to direct the acoustic transducer system 90 to send commands to the downhole casing collar locator 95. The downhole locator tool 95 may have additional receiver elements (not shown) and circuits (not shown) to enable enhanced reception of surface generated signals. The locator 95 acts according to programmed instructions in the downhole processor 115. Typical surface to downhole commands include but are not limited to commands to (a) initiate transmission of downhole stored data, (b) transmit the number of collars traversed, (c) transmit when a particular production element is identified, (d) change downhole operating modes, for example, from the storage only mode to the transmission at every collar mode, and (e) changing acoustic transmission frequency to improve surface reception.

In another preferred embodiment, a gamma ray sensor (not shown) and associated circuits (not shown) for detecting natural gamma rays emitted from the subterranean formations may be included in the downhole system. Typically, the hydrocarbon bearing formations show increased gamma ray emission over non-hydrocarbon bearing zones. This information is used to identify the various production zones for setting production tools. Any gamma detector known in the art may be used, including, but not limited to, scintillation detectors and geiger tube detectors. The gamma ray detector may be incorporated in the instrument section 155, or alternatively may be housed in a separate sub (not shown) and connected mechanically and electrically with the casing collar locator 35 using techniques known in the art.

The method of this invention for accurately determining the position of casing collars in a wellbore while moving coiled or jointed tubing within the casing comprises the following steps. An acoustic casing collar locator 35 is connected to the bottom end of coiled or jointed tubing 25 prior to running the tubing into the casing 20 in wellbore 15. The tubing 25 with the acoustic casing collar locator 35 attached is run into the casing 20 and moved therethrough. As the acoustic casing collar locator 35 passes each casing collar 30 the acoustic casing collar locator 35 senses the casing collar 30 and transmits an acoustic signal through the tubing 25 to the surface where it is detected by the surface receiver 50. The surface receiver 50 transmits an electrical signal to the surface processor 65 indicating the reception of the acoustic signal. The depth of the acoustic casing collar locator 35 is continuously measured by the depth sensor 60 and transmitted to the surface processor 65. The surface processor 65 stores the received casing collar indication as a function of the depth indicated by the depth sensor 60. Alternatively for jointed tubing, the length of each tubing joint can be manually entered into the surface processor 65. The correlated casing collar depth information can be output in tabular or graphical format for use by the operator.

An alternative method comprises the steps of, programming the downhole signal processor 115 to store the detected casing collar signal as a function of time in memory in the signal processor 115. Presetting the signal processor 115 at the surface to transmit the data after a preset time delay from starting downhole. Running the acoustic casing collar locator 35 into the hole to the approximate depth of interest quickly and then traversing the acoustic casing collar locator 35 through the section of interest at a slower rate. Storing the signal indicating detection of the casing collars in downhole memory as a function of time. Concurrently measuring and storing depth data from the depth sensor 60 in the surface processor 65 as a function of time. Stopping the movement of the coiled tubing 25 when the preset time delay expires, and transmitting the downhole stored data to the surface by activating the signal generator 105. Processing the time interval between the received signals with the surface processor 65 and correlating the tubing speed as indicated by the surface depth sensor 60 to determine the distance between collars, thereby allowing accurate placement of a well tool 55.

Another alternative method comprises, determining from a prior casing collar log, the number of collars to be traversed to a predetermined location. Storing the number of collars in the memory of the downhole signal processor 115. Preprogramming the acoustic casing collar locator 35 to send a signal when the predetermined number of collars 30 are sensed. Running the acoustic casing collar locator 35 into the hole and sensing the casing collars as the casing collar locator 35 moves past each collar 30. Comparing the number of collars 30 sensed with the predetermined number in the downhole memory and sending a signal to the surface when the predetermined number of collars is equaled. Using the signal that a predetermined collar 30 is reached, to switch to a mode of transmitting a signal as each additional collar is traversed, thereby allowing an operator to accurately set a downhole tool 55 between collars 30.

In another method, a casing collar locator tool is used to acquire the casing collar sensor signals as the sensor passes various distinctive downhole production elements, which include but are not limited to control valves, packers, gravel pack screens, and lateral kickoff hardware. The differences in geometries and relative masses of these downhole elements results in unique casing collar sensor signals, also called signatures, for each type of element. These element signatures may be stored in the memory of the downhole signal processor 115 of the casing collar locator 35 described previously. These signature signals are compared to the signals generated as the casing collar locator tool 35 is moved through the casing 20 using cross correlation or other signal comparison techniques known in the art. When a particular completion element is identified, the locator tool 35 sends a coded signal to the surface indicating which production element has been sensed. Techniques for encoding acoustic signals are well known in the art and are not discussed here further.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A system for locating casing collars disposed in a wellbore, comprising;

a. a tubing string conveyed into the wellbore;

b. a casing collar locator tool disposed in the tubing string for detecting a casing collar and generating an acoustic signal in said tubing string in response thereto wherein said acoustic signal is transmitted by said tubing string; and c. a surface system for receiving said acoustic signal.

2. The system of claim 1, wherein the casing collar locator tool comprises:

i. a sensing system disposed in the casing collar locator tool adapted to detect an increased mass of a casing collar to generate an electric signal in response thereto; and ii. an acoustic signal generator disposed in the casing collar locator tool adapted to receive the electrical signal from the sensing system and to output an acoustic signal into the tubing string in response thereto.

3. The system of claim 2, wherein the casing collar sensing system electromagnetically detects the presence of the casing collar.

4. The system of claim 2, wherein the sensing system comprises:

i. a casing collar sensor, said sensor detecting a casing collar as the sensor is moved through the casing collar and generating an electrical signal in response thereto;

ii. a signal processor adapted to detect the electrical signal from the sensor and generate[s] an activation signal to the drive circuit in response thereto; and iii. a battery pack comprising a plurality of batteries adapted to provide power to the downhole system of electronics and the signal generator.

5. The system of claim 4, wherein the signal processor comprises a programmable microprocessor and memory modules.

6. The system of claim 2, wherein the acoustic signal generator comprises a plurality of piezoelectric elements, said elements coupled to the casing collar locator tool and imparting an acoustic signal into the tubing string in response to the activation signal.

7. The system of claim 2, wherein the acoustic signal generator comprises a magnetostrictive element coupled to the casing collar locator tool for imparting an acoustic signal into the casing collar locator tool in response to the activation signal.

8. The system of claim 1, wherein the surface system comprises:

i. a surface receiver adapted to detect the acoustic signal in the tubing string, and transmit a signal in response thereto;

ii. a surface mounted depth sensor for continuously monitoring the depth of the tubing string inserted into the wellbore, said depth sensor adapted to transmit a depth signal in response to changes in the tubing depth; and iii. a surface processor for receiving the depth signal from the depth sensor and the receiver signal from the surface receiver, the surface processor operating according to a set of programmed instructions to generate a depth log for casing collar locations in the wellbore.

9. The system of claim 8, wherein the surface receiver comprises;

i. at least one rolling element urged to contact said tubing string by an actuator; and ii. at least one accelerometer coupled to the at least one rolling element for detecting vibrations in said tubing string related to said acoustic signal and generating a signal in response thereto.

10. The system of claim 9, wherein the at least one rolling element is chosen from (i) a sphere, (ii) a cylindrical roller, and (iii) a wheel.

11. The system of claim 9, wherein the actuator is one of (i) a mechanical device, (ii) a hydraulic device, and (iii) a pneumatic device.

12. The system of claim 8, wherein the surface receiver comprises;

i. a reservoir adapted to pass the tubing string therethrough;

ii. a fluid disposed in said reservoir contacting said tubing string; and iii. a pressure sensor immersed in said fluid for detecting pressure signals in said fluid related to acoustic signals in the tubing string.

13. The system of claim 12, wherein the pressure sensor is a hydrophone.

14. The system of claim 8, wherein the surface receiver comprises a hydrophone immersed in a completion fluid in an annulus between the tubing string and a casing in the wellbore for detecting pressure sugnals in said completion fluid related to acoustic signals in said tubing string.

15. A method for determining the location of downhole wellbore casing collars comprising:

a. running an acoustic collar locator tool disposed in a tubing string into a cased wellbore; and b. generating an acoustic signal in the tubing string every time the collar locator tool passes through a casing collar wherein said acoustic signal is transmitted by the tubing.

16. The method of claim 15, further comprising:

i. continually measuring the depth of the collar locator;

ii. sensing the transmitted acoustic signal with a surface receiver;

iii. recording the measured depth of said collar locator corresponding to each received acoustic signal to thereby determine the depth of each detected collar; and iv. generating a depth log for casing collar locations in the wellbore.

17. A method for determining the depth of downhole wellbore casing collars comprising:

a. presetting, at the surface, a time delay in an acoustic casing collar locator tool such that the casing collar locator tool will begin acoustically transmitting casing collar data after the time delay has expired, b. connecting the casing collar locator tool to the end of a string of tubing, running said tubing string into a cased wellbore and moving the tubing and the collar locator through the casing such that the collar locator senses each collar and stores a signal indicating collar detection in a downhole memory as a function of time, c. continuously measuring and storing the depth of the collar locator in a surface processor, d. transmitting acoustically, after the expiration of the surface preset time delay, the stored signals in the downhole memory as a function of time, e. sensing the transmitted acoustic signal with a surface receiver, and f. recording the measured depth of said collar locator corresponding to each received acoustic signal to determine the depth of each detected collar, and, g. generating a depth log for casing collar locations in the wellbore.

18. A method for locating a well tool between two predetermined casing collars, comprising;

a. presetting, at the surface, a predetermined number of casing collars into a casing collar locator, b. connecting the casing collar locator tool and a well tool to the end of a string of tubing, running said tubing having the collar locator attached thereto into a cased wellbore and moving the tubing and the collar locator through the casing such that the casing collar locator senses each collar and accumulates in a downhole memory a total number of casing collars traversed;

c. determining according to programmed instructions, when the number of collars traversed is equal to the predetermined number;

d. transmitting an acoustic signal through the tubing to the surface;

e. switching to a mode of transmitting each sensed collar;

f. sensing the transmitted acoustic signal with a surface receiver, and g. positioning the downhole tool between a predetermined pair of casing collars.

19. A method for determining the location of downhole production elements, comprising;

a. storing an existing casing collar sensor signature of a production element in an acoustic casing collar locator tool, said signature uniquely identifying a downhole production element;

b. connecting the casing collar locator tool, having a casing collar sensor, to the end of a string of tubing, running the tubing having the casing collar locator tool attached thereto into a cased wellbore and moving the tubing and the casing collar locator tool through the casing such that the locator tool senses the downhole production element and generates an electrical signal in response thereto, c. identifying the downhole production element by comparing the electrical signal to the stored downhole element signatures using signal comparison techniques programmed into a downhole processor in the locator tool, d. transmitting an encoded acoustic signal through the tubing, e. measuring the depth of the collar locator continuously, f. sensing and decoding the transmitted acoustic signal with a surface receiver, g. recording the depth of said collar locator corresponding to the received encoded acoustic signal to thereby determine the depth of the detected downhole production element, and, h. generating a depth log of downhole production elements in the wellbore.

20. The method of claim 19, wherein the signal comparison technique used is cross correlation.

21. A method for locating a well tool by using a downhole production element as a locating benchmark, comprising;

a. presetting, at the surface, a casing collar sensor signature of a predetermined production element into a casing collar locator, b. connecting the casing collar locator tool and the well tool to the end of a string of tubing, running said tubing having the collar locator attached thereto into a cased wellbore and moving the tubing and the collar locator through the casing such that the casing collar locator senses the predetermined production element and generates an electric signal in response thereto;

c. identifying the downhole production element by comparing the electrical signal to the stored downhole element signatures using signal comparison techniques programmed into a downhole signal processor in the locator tool, d. transmitting an encoded acoustic signal through the tubing, e. measuring the depth of the collar locator continuously, f. sensing and decoding the transmitted acoustic signal with a surface receiver, g. recording the depth of said collar locator corresponding to the received encoded acoustic signal to thereby determine the depth of the detected downhole production element, and, h. positioning the well tool a predetermined distance from said production element.

22. The method of claim 21, wherein the signal comparison technique used is cross correlation.

23. An acoustic casing collar locator system for indicating the depth of casing collars in a wellbore comprising:

a. a mandrel having a first end adapted to engage a section of a tubing string, and a second end adapted to engage a well tool, b. a housing adapted to sealably fit over the mandrel, c. a system of electronics disposed on the mandrel adapted to detect an increased mass of a casing collar and generating an electric signal in response thereto, d. an acoustic signal generator adapted to receive the electrical signal from the system of electronics and to generate an acoustic signal in the tubing string in response thereto wherein said acoustic signal is transmitted by said tubing string, e. a downhole acoustic signal receiver adapted to receive acoustic command signals from the surface, f. a surface receiver adapted to detect the acoustic signal in the tubing string, said surface receiver transmitting a locator signal to a surface processor in response to receiving said acoustic signal, g. a surface transmitter acting according to programmed instructions in the surface processor, said surface transmitter adapted to impart an acoustic signal into the tubing string to command the downhole locator tool to act according to programmed instructions in the downhole tool, h. a surface mounted depth sensor for continuously monitoring the depth of the tubing string inserted into the wellbore, said depth sensor adapted to continuously transmit a depth signal in response to changes in the tubing depth, and i. a surface processor for receiving the depth signal from the depth sensor and the locator signal from the surface receiver, the surface processor operating according to a set of programmed instructions to generate a depth log for casing collar locations in the wellbore.

24. The system of claim 23, wherein the casing collar sensor electromagnetically detects the presence of the casing collar.

25. The system of claim 23, wherein the system of electronics comprises:

i. a casing collar sensor, said sensor detecting a casing collar as the sensor is moved through the casing collar and generating an electrical signal in response thereto, ii. a signal processor adapted to detect the electrical signal from the sensor and generates an activation signal to the drive circuit in response thereto, and iii. a battery pack comprising a plurality of batteries adapted to provide power to the downhole system of electronics and the signal generator.

26. The system of claim 25, wherein the signal processor comprises a programmable microprocessor and memory modules.

27. The system of claim 23, wherein the acoustic signal generator comprises a plurality of piezoelectric elements, said elements adapted for mounting on the mandrel and for imparting an acoustic signal into the mandrel in response to the activation signal.

28. The system of claim 23, wherein the downhole signal receiver comprises a plurality of piezoelectric elements.

29. The system of claim 23, wherein the acoustic signal generator comprises a magnetosrictive element adapted for mounting on the mandrel and for imparting an acoustic signal into the mandrel in response to the activation signal.

30. A method for changing operating modes in a downhole acoustic casing collar locator, comprising;

a. connecting a casing collar locator tool to the end of a string of tubing, said tool comprising casing collar sensor, a signal processor, a signal generator, a signal receiver, and a power source, said signal processor comprising a microprocessor and memory modules;

b. running said tubing having the collar locator attached thereto into a cased wellbore and moving the tubing and the collar locator through the casing such that the collar locator senses each collar and activates an acoustic signal generator every time the collar locator passes through a casing collar, thereby generating an acoustic signal which is transmitted by the tubing, c. using a surface processor to send a command to a surface acoustic transducer system, said acoustic transducer system adapted to transmit acoustic signal to, and to receive acoustic signals from, the acoustic casing collar locator tool;

d. receiving the surface transmitted signals by the downhole acoustic casing collar tool, said downhole acoustic casing collar tool acts in response to the received signal according to a set of programmed instructions in the signal processor.

* * * * *